US005815771A

United States Patent [19]

Dhande et al.

[11] Patent Number: 5,815,771

[45] Date of Patent: Sep. 29, 1998

[54] APPARATUS FOR APPLYING A HIGH VOLTAGE ELECTRICAL POINT OF LOAD CONTACT

[75] Inventors: Kisan S. Dhande, Webster; James R. Bryce; Bruce D. Caryl, both of Fairport; Timothy A. Cole, Henrietta; Elizabeth D. Diehl; Ihor Kulbida, both of Fairport, all of N.Y.; Fernando P. Yulo, Mississauga, Canada

[73] Assignee: Xerox Corporation, Stamford, Conn.

[21] Appl. No.: 838,632

[22] Filed: Apr. 11, 1997

[51] Int. Cl.[6] ..... G03G 15/00

[52] U.S. Cl. ..... 399/90; 399/110

[58] Field of Search ..... 399/37, 88, 90, 399/107, 110

[56] References Cited

U.S. PATENT DOCUMENTS

| | | | |
|---|---|---|---|
| 4,945,255 | 7/1990 | Suzuki et al. | 399/88 X |
| 5,089,855 | 2/1992 | Mochimaru | 399/110 X |
| 5,450,167 | 9/1995 | Okano et al. | 399/88 |
| 5,561,499 | 10/1996 | Setoriyama | 399/90 X |
| 5,581,325 | 12/1996 | Tsuda et al. | 399/90 X |
| 5,634,175 | 5/1997 | Michlin et al. | 399/90 |

*Primary Examiner*—Sandra L. Brase
*Attorney, Agent, or Firm*—Kevin R. Kepner

[57] ABSTRACT

A printing machine having multiple distributed high voltage power supplies is disclosed. The printing machine comprises a print engine having a plurality of high voltage electrical printing machine components. A housing supports at least one of the high voltage power supplies. A receptacle mounted on the housing receives an external connector from one of the machine components. The receptacle is fixed on the housing and is not detachable. A contact located inside the receptacle electrically connects circuitry from the power supply to the external connector. A second contact on the housing electrically connects circuitry from the power supply to a second external connector on the machine component.

20 Claims, 5 Drawing Sheets

APPARATUS FOR APPLYING A HIGH VOLTAGE ELECTRICAL POINT OF LOAD CONTACT

This invention relates to power supplies for corona generating devices that deposit charge on an adjacent surface. More particularly, the present invention concerns a high voltage electrical point of load contact to the corona charging device from a power supply that eliminates an interconnecting cable therebetween.

In a typical electrophotographic printing process, a photoconductive member is charged by a corona device to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, corona devices perform a variety of functions in the printing process. For example, corona devices aid the transfer of the developed toner image from a photoconductive member to a transfer member. Likewise, corona devices aid the conditioning of the photoconductive member prior to, during, and after deposition of developer material thereon to improve the quality of the electrophotographic copy produced thereby. Both direct current (DC) and alternating current (AC) type corona devices are used to perform these functions.

One form of a corona charging device comprises a corona electrode in the form of an elongated wire connected by way of an insulated cable to a high voltage AC/DC power supply. The corona wire is partially surrounded by a conductive shield. The photoconductive member is spaced from the corona wire on the side opposite the shield. An AC voltage may be applied to the corona wire and at the same time, a DC bias voltage is applied to the shield to regulate ion flow from the corona wire to the photoconductive member being charged.

Another form a corona charging device is a dicorotron. The dicorotron comprises a coronode having a conductive wire that is coated with an electrically insulating material. When AC power is applied to the coronode by way of an insulated cable, substantially no net DC current flows in the wire due to the thickness of the insulating material. Thus, when the conductive shield forming a part of the dicorotron and the photoconductive member passing thereunder are at the same potential, no current flows to the photoconductive member or the conductive shield. However, when the shield and photoconductive member are at different potentials, for example, when there is a copy sheet attached to the photoconductive member to which toner images have been electrostatically transferred thereto, an electrostatic field is established between the shield and the photoconductive member which causes current to flow from the shield to ground.

Still other forms of corona charging devices include pin corotrons and scorotrons. The pin corotron comprises an array of pins integrally formed from a sheet metal member that is connected by a high voltage cable to a high power supply. The sheet metal member is supported between insulated end blocks and mounted within a conductive shield. The photoconductive member to be charged is spaced from the sheet metal member on the opposite side of the shield. The scorotron is similar to the pin corotron, but is additionally provided with a screen or control grid disposed between the coronode and the photoconductive member. The screen is held at a lower potential approximating the charge level to be placed on the photoconductive member. The scorotron provides for more uniform charging and prevents over charging.

Each of corona generating devices described are provided with high voltage connectors and cables for insertion into operating positions located away from a central power supply in the printing machine. However, the use of a high voltage cable between the corona charging device and the power supply has many problems. First, the insulation resistance (IR) of the cable must withstand a breakdown voltage greater than the corona generating voltage, making the cable an expensive machine component. Second, chemical reactivity in the corona environment causes the dielectric strength of the cable to deteriorate so that a substantial amount of current leaks to machine ground rather than being transferred to the coronode. Thus, preventive maintenance requires that the cable be periodically replaced to prevent current leakage. This preventive maintenance requirement increases both the down time of the machine and the service cost to the customer. Third, leakage current in the form of unwanted electrical arcing causes electromagnetic interference to sensitive electronic circuitry in other areas of the machine that ultimately control the quality of the reproduced image.

Clearly, it would be highly desirable to employ a high voltage point of load electrical contact for corona charging devices that reduces or eliminates the problems heretofore described. The high voltage electrical contact of the present invention is designed to establish direct electrical contact between separate high voltage power supplies and their corresponding loads including corona generating devices. This type of contact is more reliable merely by removing expensive high voltage cables and their inherent failure modes and by reducing the number of electrical contact points between the power supply and load. The removal of high voltage cables reduces customer incurred service costs because periodic cable replacement is no longer required. Electromagnetic interference is reduced by virtue of eliminating the radiating wires. Furthermore, machine assembly costs are reduced due to the elimination of stand-off insulators used to support the high voltage cables away from grounded surfaces in the machine where arcing thereto causes electromagnetic interference. The high voltage point of load electrical contact allows limited movement of the corona generating devices without breaking contact. Additionally, a common standard architecture for the high voltage connector reduces high voltage power supply cost. Finally, the point of load type electrical contact is adaptable to different configurations for different charge device functions.

The following disclosures may relate to various aspects of the present invention.

U.S. Pat. No. 4,239,173

Patentee: Donald J. Weikel, Jr.

Issue Date: Dec. 16, 1980

U.S. Pat. No. 4,564,282

Patentee: Vittal U. Shenoy

Issue Date: Jan. 14, 1986

Some portions of the foregoing disclosures may be briefly summarized as follows:

U.S. Pat. No. 4,239,173 discloses a single power supply for energizing multiple corona generating devices employed in an electrophotographic printing machine. Both AC and DC corona generators are powered from the same supply. The power supply includes of a power transformer having a step-up winding ratio at each of two secondary windings relative to a primary winding. Unfiltered, full wave rectified voltage developed from circuitry connected to the secondary windings power the DC charging and transfer corona generators. The AC detack and erase corona generators are driven directly by the secondary windings.

U.S. Pat. No. 4,564,282 discloses a power supply having a transformer with a single secondary winding connected to four corona generating devices in a xerographic reproducing machine. Each corona device comprises the same dicorotron structure having an electrode capacitively coupled to the AC voltage source of the secondary winding. However, the bias voltages and methods of applying them are different. In the case of the detack corona device, the shield is connected to ground through a resistor. A diode in series with a variable resistor is provided in the shield circuit of the preclean dicorotron to allow only half the AC current in the coronode circuit to flow through the shield circuit. Diodes connected in series with variable resistors couple the shields of the transfer and charge dicorotrons to provide the biases of the desired polarity. A separate variable resistor in each circuit connects the secondary winding to the transfer and charge shields. The purpose of the resistors is to effect a phase shift between the voltages applied to the shield electrode of the transfer and charge corona device so that the electrostatic field therebetween does not collapse.

In accordance with one aspect of the present invention, there is provided a printing machine having multiple distributed high voltage power supplies. The printing machine comprises a print engine having a plurality of high voltage electrical printing machine components. A housing supports at least one of the high voltage power supplies. A receptacle mounted on the housing receives a first external connector from one of the machine components. The receptacle is fixed on the housing and is not detachable from the housing. A contact located inside the receptacle electrically connects circuitry from one of the power supplies supported by the housing to the first external connector. A second contact on the housing electrically connects circuitry from the power supply to a second external connector on the machine component.

Pursuant to another aspect of the present invention, there is provided an electrophotographic printing machine having multiple distributed high voltage power supplies. The electrophotographic printing machine comprises a print engine having a plurality of high voltage electrical printing machine components. A housing supports at least one of the high voltage power supplies. A receptacle mounted on the housing receives a first external connector from one of the machine components. The receptacle is fixed on the housing and is not detachable from the housing. A contact located inside the receptacle electrically connects circuitry from one of the power supplies supported by the housing to the first external connector. A second contact on the housing electrically connects circuitry from the power supply to a second external connector on the machine component.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
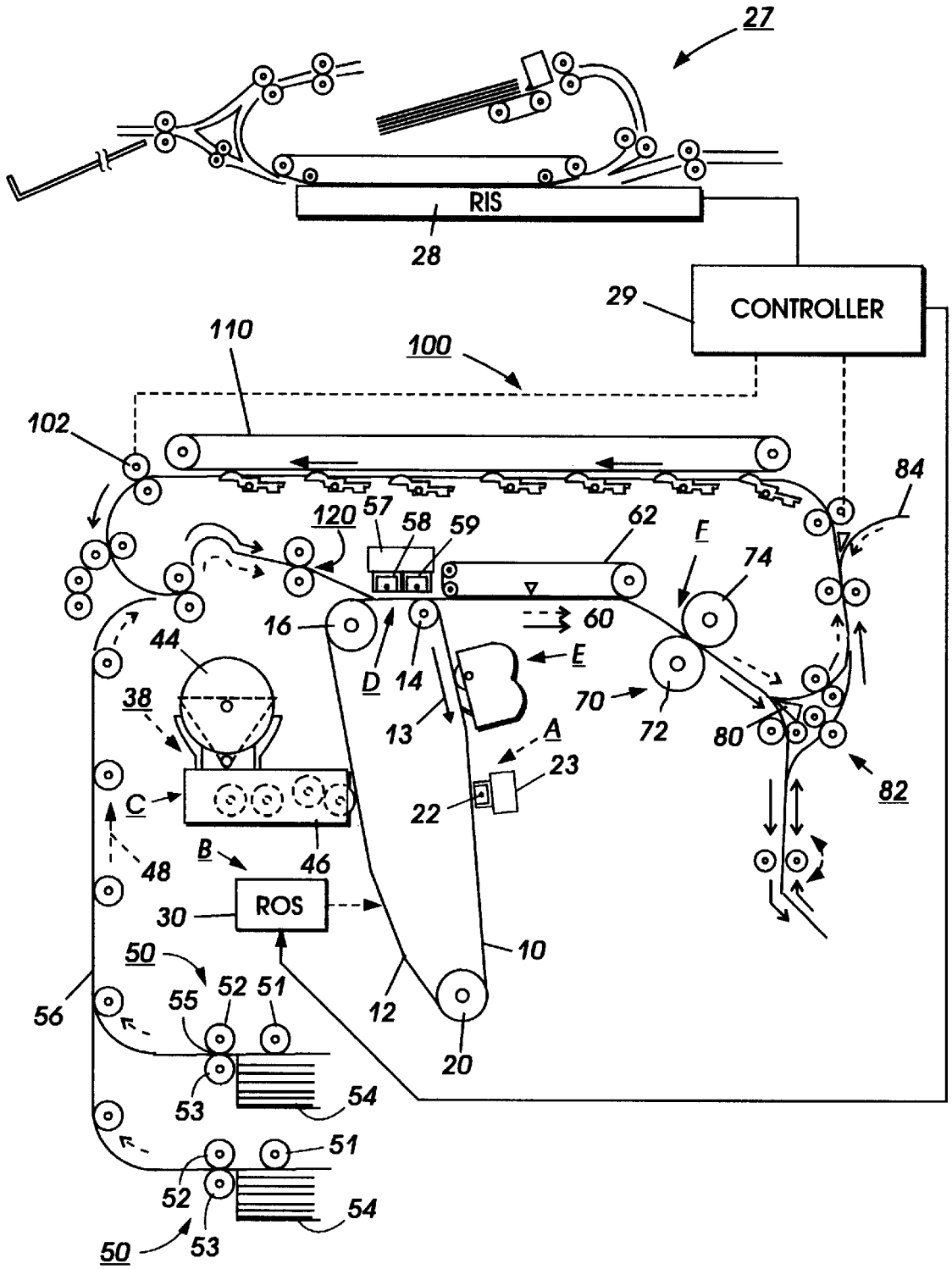
FIG. 1 is a schematic elevational view of a typical electrophotographic printing machine utilizing high voltage point of load electrical contacts of the present invention to contact corona charging devices.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the high voltage electrical point of load contact of the present invention may be employed in a wide variety of devices and is not specifically limited in its application to the particular embodiments depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive surface material 12 coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential. Corona generating device 22 is affixed to a high voltage electrical point of load contact device 23 of the present invention that will be discussed with reference to FIG. 6. One skilled in the art will recognize that the point of load refers to the total demand for electrical power on a high voltage power supply (not shown)

connected to corona generating device 22. For example, the voltage and current requirements for a corona generator are approximately 5 to 10 kilovolts and 200 micro-amperes to 2 milli-amperes, respectively.

At an exposure station B, a controller or electronic subsystem (ESS), indicated generally by reference numeral 29, receives the image signals representing the desired output image and processes these signals to convert them to a continuous tone or gray-scale rendition of the image which is transmitted to a modulated output generator, for example a raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into a registration transport 120 located before image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detached from the photoreceptor by corona device 59 which generates an AC field that is biased oppositely to that of corona device 58 to assist in removing the sheet from the photoreceptor. Both the transfer and detack corona generators 58 and 59 are affixed to a high voltage electrical point of load contact device 57 of the present invention that will be discussed with reference to FIGS. 3 through 5. The high voltage point of contact device 57 connects each corona generator to a respective high voltage power supply (not shown) contained therein. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
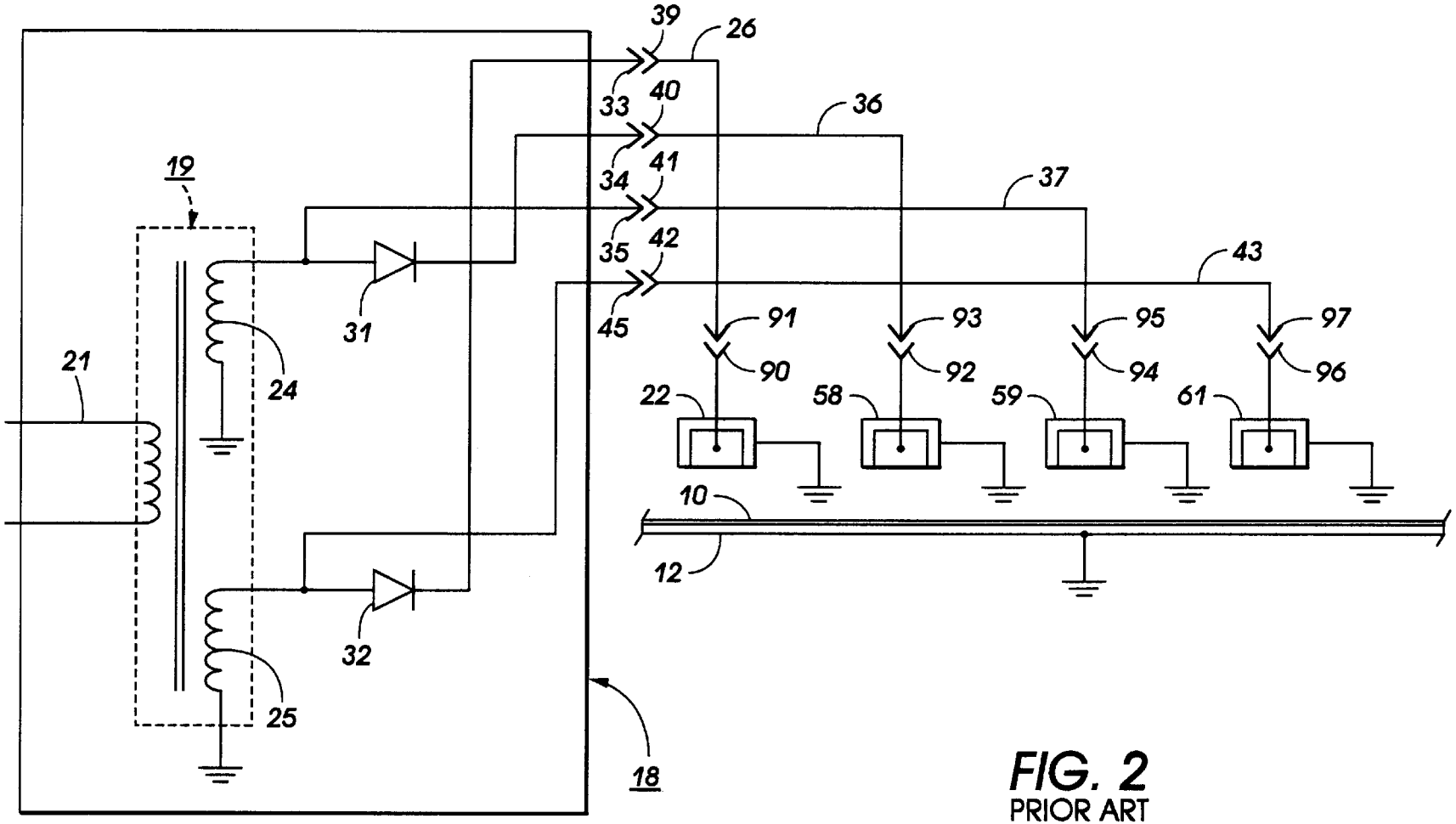
FIG. 2 PRIOR ART
FIG. 2 is a simplified circuit diagram of a prior art power supply for energizing multiple corona generating devices.

Turning now to FIG. 2, there is shown a simplified circuit diagram of a prior art high voltage power supply for energizing corona generating devices 22, 58, 59, and 61. The photoconductive member 10 on the grounded substrate 12 is spaced from the corona charging devices on the side opposite the shields. Power supply 18 includes a transformer 19 whose primary winding 21 includes input terminals (not shown) for connection to a 115 volt, 50–60 hertz AC line voltage source (not shown) or an appropriately conditioned DC to AC converter (not shown). The secondary windings 24 and 25 have step-up winding ratios relative to primary 21 for generating the high voltages required by the corona generating devices. Collectively, the secondary windings 24 and 25, and diodes 31 and 32 effect a rectified DC voltage of the voltage applied to primary 21. This DC voltage is coupled by way of connectors 33 and 34 to high voltage cables 26 and 36. Cable 26 has terminals 39 and 91 fastened thereto to contact connectors 33 and 90. Likewise, cable 36 has terminals 40 and 93 fastened thereto to contact connectors 34 and 92. Secondary windings 24 and 25 also separately provide AC voltages to corona generators 59 and 61 by way of high voltage cables 37 and 43. Cable 37 has terminals 41 and 95 fastened thereto to contact connectors 35 and 94, respectively. In a similar manner, cable 43 has terminals 42 and 97 fastened thereto to contact connectors 45 and 96.

The cables 26, 36, 37, and 43 provide high voltage connections between power supply 18 and the corona generating devices so that they can be inserted into a printing machine. Since printing machines tend to require a great deal of the maintenance (such as the cleaning required for the charging devices), it is desirable that the charging devices be easily removed and reinserted. They should have a direct connection to the power source to eliminate or reduce the problems discussed hereinbefore. The high voltage point of electrical load contact device of the present invention eliminates cables 26, 36, 37, and 43 and provides direct connection between the corona generators and their separate power supplies without the necessity of maintaining tight positioning tolerances for electrical contacts.

Figure 3:
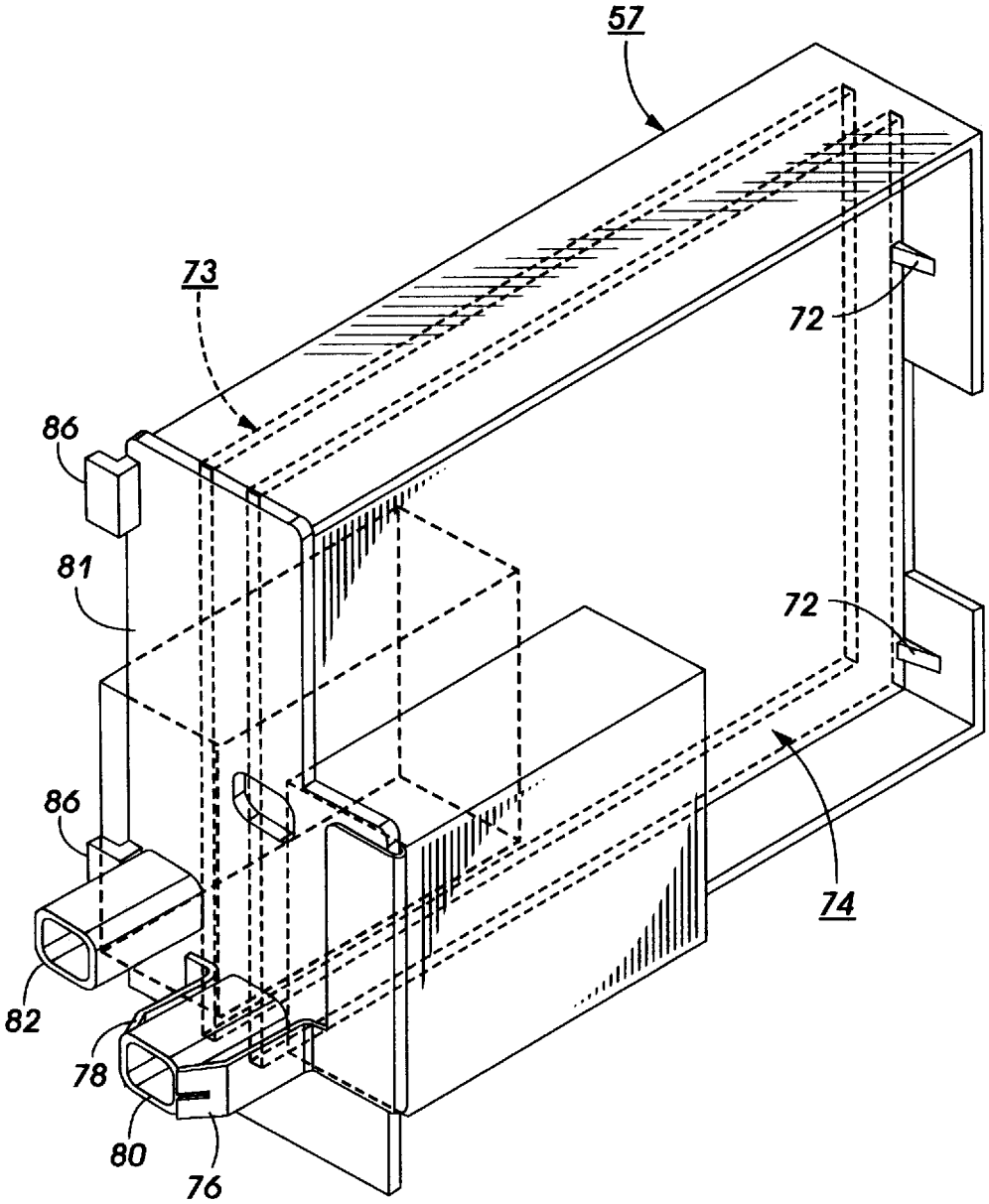
FIG. 3 is a perspective view of one embodiment of a high voltage point of load electrical contact to a corona charging device in accordance with the present invention.

Referring next to FIG. 3 there is shown a perspective view of one embodiment of a high voltage point of electrical load contact device 57 in accordance with the present invention. The high voltage point of electrical load contact device is composed of a non-conductive housing molded from a thermoplastic material. The high voltage point of electrical load contact device 57 is adapted to be removably attached to a machine member (not shown) by way tabs 86 at the top and bottom of a panel 81. Two oppositely adjacent printed circuit board-type high voltage power supplies 73 and 74 are mounted behind panel 81 and are held in place by tabs 72. Attached to panel 81 are contacts 76 and 78 in the form of electrically conductive leaf springs. Contacts 76 and 78 are adapted to electrically connect low voltage from power supplies 74 to mating external connectors on detack corona generators 58 and 59 (FIG. 1). Receptacles 80 and 82 on the front of panel 81 each receive an external high voltage connector from the transfer and detack corona generators 58 and 59 (FIG. 1). The receptacles 80 and 82 are fixed on the housing and are not detachable therefrom. They will be discussed hereinafter, in further detail, with reference to FIG. 4.

Figure 4:
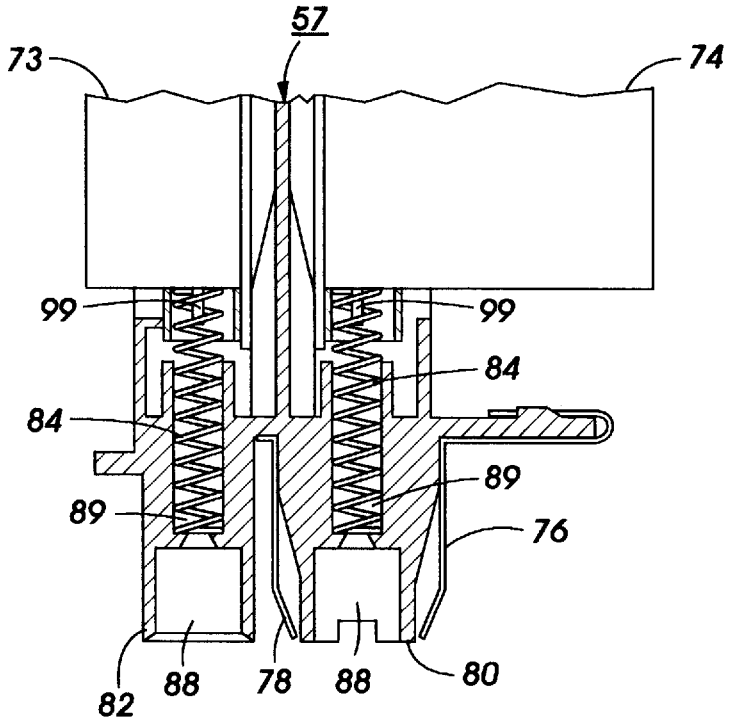
FIG. 4 is a fragmentary schematic, cross-sectional view showing the point of load contacts in the FIG. 3 embodiment.

Referring now to FIG. 4 there is shown a cross-sectional view of receptacles 80 and 82 in the FIG. 3 embodiment. Receptacles 80 and 82 are composed of an internal recess 88 coupled to a conically elongated passageway 89. Each of the passageways 89 contains a coiled spring 84 with one end engaging high voltage output terminals 99 at power supplies 73 and 74, respectively. The opposite ends of springs 84 engage an external high voltage connector on the transfer and detack corona generators 58 and 59 (FIG. 1) as described with reference to FIG. 5.

Figure 5:
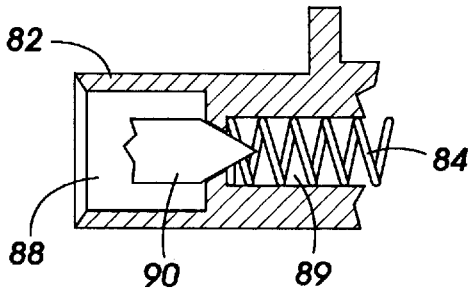
FIG. 5 is a fragmentary schematic, cross-sectional view of the FIG. 3 device having a corona generating device inserted therein.

In FIG. 5, there is shown a cross-sectional view of the FIG. 3 receptacle 82 having an exemplary terminal 90 inserted therein. Terminal 90 is a fragmentary portion of the external high voltage connector on the transfer corona generator 58 (FIG. 1). The high voltage connector enters recess 88, wherein the pointed end of terminal 90 engages the front end of spring 84 located in the elongated passageway 89. Terminal 90 compresses spring 84 and urges the rear end of spring 84 against the high voltage output terminal 99 of power supply 73 (FIG. 4) to establish an electrical point of load contact therebetween.

Figure 6:
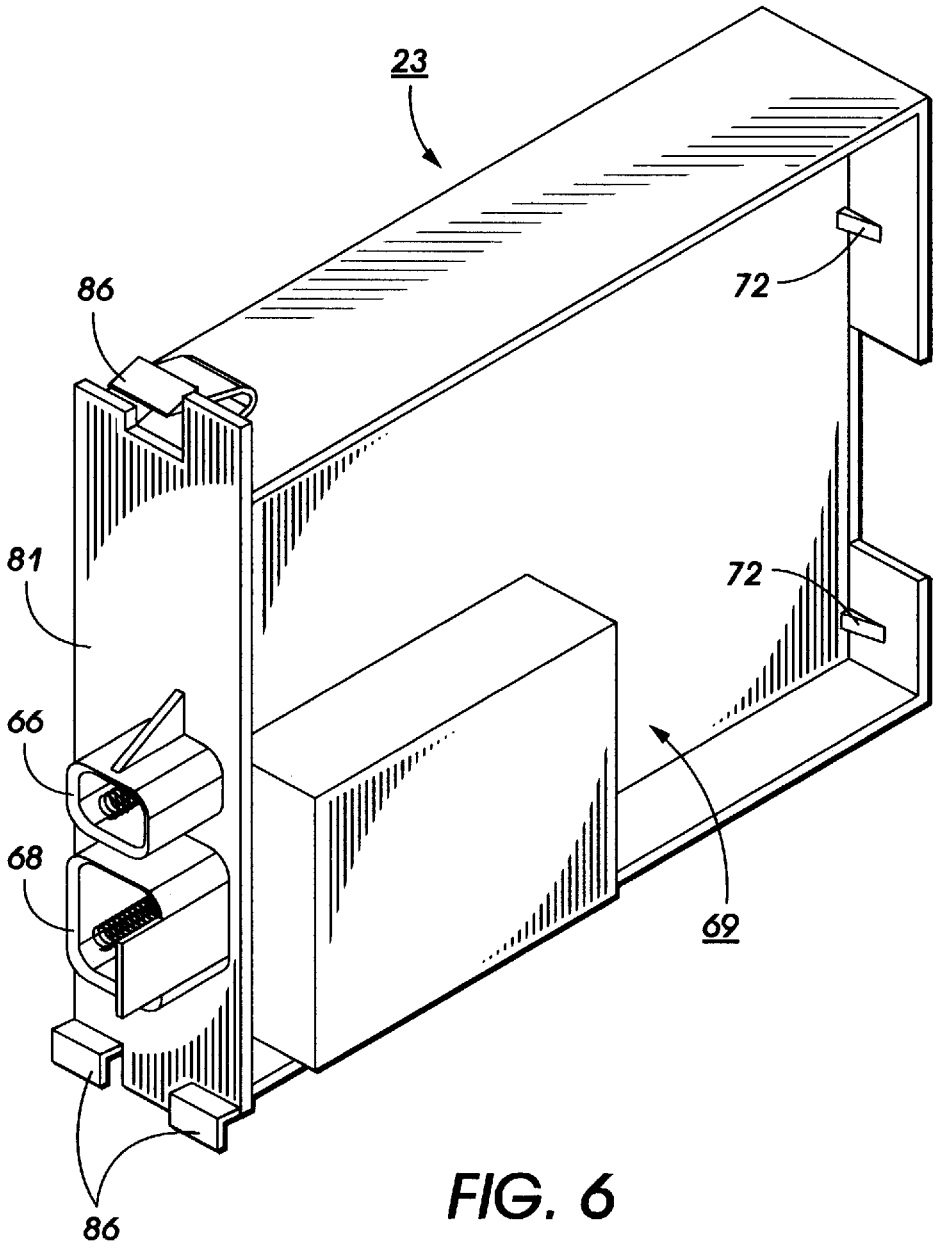
FIG. 6 is a perspective view of a second embodiment of the high voltage point of load electrical contact to a corona charging device in accordance with the present invention.

In FIG. 6 there is shown a perspective view of a second embodiment of the high voltage point of load electrical contact device 23 in accordance with the present invention. The high voltage point of electrical load contact device 23 is also composed of a non-conductive, thermoplastic housing material adapted to be removably attached to a machine member (not shown) by way tabs 86 at the top and bottom of a panel 81. However, only one printed circuit board-type high voltage power supply 69 is mounted behind panel 81 and held in place by a plurality of tabs 72. Attached to the front of panel 81 are receptacles 66 and 68 which are fixed on the housing and are not detachable therefrom. Receptacle 66 receives an external high voltage coronode connector from the charge corona generator 22 (FIG. 1). In a similar manner, receptacle 68 receives an external high voltage screen or control grid connector from the charge corona generator 22 (FIG. 1). The external high voltage connectors contact a coil spring 84 (discussed hereinbefore with reference to FIG. 4) that contact high voltage output terminals on power supply 69.

While the invention herein has been described in the context of energizing corona generating devices, it will be readily apparent that the high voltage point of electrical load contact device can be utilized to energize other high voltage printing machine components such as: bias transfer rolls, developer housing voltages, development voltages, and the like.

It is, therefore, apparent that there has been provided in accordance with the present invention, a high voltage point of electrical load contact to a corona charging device that fully satisfies the aims and advantages hereinbefore set forth. While this invention has been described in conjunction with specific embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A printing machine having multiple distributed high voltage power supplies, comprising:

a print engine having a plurality of high voltage electrical printing machine components;

a housing to support at least one of the high voltage power supplies;

at least one receptacle mounted on said housing for receiving an external connector of one of said machine components, wherein said receptacle is fixed on said housing and is not detachable from said housing;

a first contact located inside said receptacle for electrically connecting circuitry of one of said power supplies supported by said housing to said external connector; and a second contact affixed to said housing for electrically connecting circuitry of one of said power supplies supported by said housing to a second external connector on the machine component.

2. A printing machine according to claim 1, wherein said first contact is a biased member.

3. A printing machine according to claim 2, wherein said biased member is a coiled spring.

4. A printing machine according to claim 1, wherein said second contact is a biased member.

5. A printing machine according to claim 4, wherein said biased member is a leaf spring.

6. A printing machine according to claim 4, wherein said biased member is a coiled spring.

7. A printing machine according to claim 6, wherein said coiled spring is mounted in a second receptacle.

8. A printing machine according to claim 7, wherein said second receptacle is fixed on the housing and is not detachable from the housing.

9. A printing machine according to claim 1, wherein said housing supports a plurality of high voltage power supplies.

10. A printing machine having multiple distributed high voltage power supplies, comprising:

a print engine having a plurality of high voltage electrical printing machine components;

a plurality of housings to support the high voltage power supplies;

at least one receptacle mounted on each of said housings for receiving an external connector of one of said machine components, wherein said receptacle is fixed on said housings and is not detachable from said housings;

a first contact located inside said receptacle for electrically connecting circuitry of one of said power supplies supported by said housings to said external connector; and a second contact affixed to said housing s for electrically connecting circuitry of one of said power supplies supported by said housings to a second external connector on the machine component.

11. An electrophotographic printing machine having multiple distributed high voltage power supplies, comprising:

a print engine having a plurality of high voltage electrical printing machine components;

a housing to support at least one of the high voltage power supplies;

a receptacle mounted on said housing for receiving a first external connector of one of said machine components, wherein said receptacle is fixed on said housing and is not detachable from said housing;

a first contact located inside said receptacle for electrically connecting circuitry of one of the power supplies supported by said housing to the first external connector; and a second contact on said housing for electrically connecting circuitry of one of the power supplies supported by said housing to a second external connector on the machine component.

12. An electrophotographic printing machine according to claim 11, wherein said first contact is a biased member.

13. An electrophotographic printing machine according to claim 12, wherein said biased member is a coiled spring.

14. An electrophotographic printing machine according to claim 11, wherein said second contact is a biased member.

15. An electrophotographic printing machine according to claim 14, wherein said biased member is a leaf spring.

16. An electrophotographic printing machine according to claim 14, wherein said biased member is a coiled spring.

17. An electrophotographic printing machine according to claim 16, wherein said coiled spring is mounted in a second receptacle.

18. An electrophotographic printing machine according to claim 17, wherein said second receptacle is fixed on the housing and is not detachable from the housing.

19. An electrophotographic printing machine according to claim 11, wherein said housing supports a plurality of high voltage power supplies.

20. An electrophotographic printing machine having multiple distributed high voltage power supplies, comprising:

a print engine having a plurality of high voltage electrical printing machine components;

a plurality of housings to support the high voltage power supplies;

a receptacle mounted on each of said housings for receiving an external connector of one of said machine components, wherein said receptacle is fixed on said housings and is not detachable from said housings;

a first contact located inside said receptacle for electrically connecting circuitry of one of said power supplies supported by said housings to said external connector; and a second contact affixed to said housings for electrically connecting circuitry of one of said power supplies supported by said housings to a second external connector on the machine component.

* * * * *